US007338264B2

(12) United States Patent
Lifson

(10) Patent No.: US 7,338,264 B2
(45) Date of Patent: Mar. 4, 2008

(54) RECESSES FOR PRESSURE EQUALIZATION IN A SCROLL COMPRESSOR

(75) Inventor: Alexander Lifson, Manlius, NY (US)

(73) Assignee: Scroll Technologies, Arkadelphia, AR (US)

( * ) Notice: Subject to any disclaimer, the term of this patent is extended or adjusted under 35 U.S.C. 154(b) by 183 days.

(21) Appl. No.: 11/361,759

(22) Filed: Feb. 24, 2006

(65) Prior Publication Data

US 2006/0269432 A1 Nov. 30, 2006

Related U.S. Application Data

(60) Provisional application No. 60/685,854, filed on May 31, 2005.

(51) Int. Cl.
*F01C 1/02* (2006.01)

(52) U.S. Cl. ..... 418/55.2; 418/75; 418/55.1; 418/55.5; 418/57

(58) Field of Classification Search ..... 418/55.1, 418/55.2, 75, 55.5, 57
See application file for complete search history.

(56) References Cited

U.S. PATENT DOCUMENTS 5,370,512 A * 12/1994 Fujitani et al. ..... 418/55.2
6,089,839 A * 7/2000 Bush et al. ..... 418/55.2
6,139,287 A * 10/2000 Kuroiwa et al. ..... 418/55.1
6,142,753 A * 11/2000 Bush et al. ..... 418/55.1
6,171,086 B1 1/2001 Lifson
6,430,959 B1 * 8/2002 Lifson ..... 62/505
6,517,332 B1 * 2/2003 Lifson et al. ..... 418/55.5
6,773,242 B1 * 8/2004 Perevozchikov ..... 418/55.2
7,118,358 B2 * 10/2006 Tsubono et al. ..... 418/55.1
7,228,710 B2 * 6/2007 Lifson ..... 418/55.2
2002/0114720 A1 * 8/2002 Itoh et al. ..... 418/55.2
2004/0146419 A1 * 7/2004 Kawaguchi et al. ..... 418/55.1

FOREIGN PATENT DOCUMENTS

JP 07293459 A * 11/1995

* cited by examiner

*Primary Examiner*—Thomas Denion
*Assistant Examiner*—Mary A Davis
(74) *Attorney, Agent, or Firm*—Carlson, Gaskey & Olds

(57) ABSTRACT

A scroll compressor is provided with spaced grooves in a base of one of the two scroll members. A recess is formed in a wrap tip of the other scroll member. The recess in the wrap tip bridges a space between the grooves of the other scroll member. This bridging equalizes pressure between two parallel intermediate compression chambers. Pressure equalization between the chambers improves compressor efficiency.

14 Claims, 2 Drawing Sheets

RECESSES FOR PRESSURE EQUALIZATION IN A SCROLL COMPRESSOR

RELATED APPLICATIONS

The application claims priority to U.S. Provisional Application No. 60/685,854 which was filed on May 31, 2005.

BACKGROUND OF THE INVENTION

Scroll compressors typically include two interfitting scroll members, each having a base and a generally spiral wrap extending from the base. The two wraps interfit to define a pair of compression chambers in which refrigerant is compressed in a parallel manner.

Refrigerant ideally enters the chambers in equal amounts, and the chambers then seal and move toward a compressor discharge. Additional refrigerant can be added to the compression chambers by various options, such as the injection of an economizer fluid or liquid injection.

An economizer fluid is returned to the compressor when an economizer cycle is in operation. Essentially, an economizer cycle taps a flow of refrigerant downstream of a heat exchanger which receives a compressed refrigerant from a compressor. The tapped refrigerant is expanded, and passed through an economizer heat exchanger where it cools a main refrigerant flow. This increases the cooling capacity of the main refrigerant flow. The tapped fluid, having passed through the economizer heat exchanger, is returned to the compressor. Typically, the returned fluid is injected into the compression chambers at an intermediate point in the compression cycle.

Efforts are made to ensure that the pressure of refrigerant to be compressed in each of the opposed compression chambers is equal. However, in practice, it has been difficult to ensure that the pressure is equal. It becomes particularly difficult to ensure equal pressure when the economizer function is in operation and vapor is being injected into the compression chambers. It is also difficult to assure that pressure remains equal within the compression chambers when liquid injection is used to reduce the compressor discharge temperature.

Different pressure in the two intermediate compression chambers leads to additional losses during porting, as the refrigerant streams of different pressure will merge into a common discharge chamber as the refrigerant exits form each of the intermediate compression chambers. This results in additional mixing losses as two streams of different pressure merge together during porting. Having different pressure at each compression chamber during porting also makes it impossible to achieve an optimum built-in volume ratio for a rating point, because at least one parallel compression path during compression will operate at the non-optimum built-in pressure ratio.

Historically, scroll compressors had wraps which were of a generally constant thickness. However, with further design development, much study went into the shape of the wraps. The wraps are now often of a varying shape for many different design reasons. These varying shapes have varying thicknesses. Such varying thickness shaped wraps are known as "hybrid" wraps. The problem mentioned above becomes especially acute for a hybrid-type scroll wrap profile, as the injection ports for the economizer fluid have different geometry and sizes for each compression chamber. Having different geometry ports makes it especially difficult to achieve equal pressure in each compression chamber, because depending on the operating condition it would be difficult to inject the same amount of refrigerant into each chamber.

It is known in the prior art to have a groove, which connects the two opposed compression chambers in an attempt to equalize pressure between the chambers. An example is illustrated in U.S. Pat. No. 6,171,086. However, this prior art method only communicates the two chambers for a short period of time.

SUMMARY OF THE INVENTION

A scroll compressor includes a first scroll member and a second scroll member. Each scroll member has a base and a generally spiral wrap extending from the base. One of the two scroll members is caused to orbit relative to a non-orbiting scroll member. As is known, the wraps interfit to define compression chambers. The two compression chambers are reduced in size as the orbiting scroll orbits relative to the non-orbiting scroll. A method of equalizing the pressure in these two compression chambers is disclosed, and provides pressure equalization for a greater period of an orbiting cycle than was the case in the prior art.

In a disclosed embodiment of this invention, spaced grooves are formed in the base of one of a first scroll member and a second scroll member. A recess is formed in the wrap tip of the other. During a portion of the orbiting cycle, the recess bridges a space between the grooves as the wrap of the orbiting scroll orbits relative to the non-orbiting scroll. Refrigerant is thus selectively communicated between the first and second compression chambers and pressure in the two can equalize. Due to the recess, this communication will occur over a greater period of time than is the case in the prior art. It should be pointed out that the geometry of the grooves and recess is selected to assure that there is a communication between the two intermediate parallel chambers via the recess. At the same time, the geometry of the grooves and the recess is selected such that there is no or just minimal unwanted communication between the intermediate chambers and discharge chamber to minimize high to low leak.

In the disclosed embodiment, the scroll compressor may additionally include an economizer cycle and economizer injection ports extending through the wraps of the non-orbiting scroll member. While particular arrangements and shapes are disclosed, other shapes can be utilized for the grooves and recesses.

These and other features of the present invention can be best understood from the following specification and drawings, the following of which is a brief description.

DETAILED DESCRIPTION OF THE PREFERRED EMBODIMENT

Figure 1:
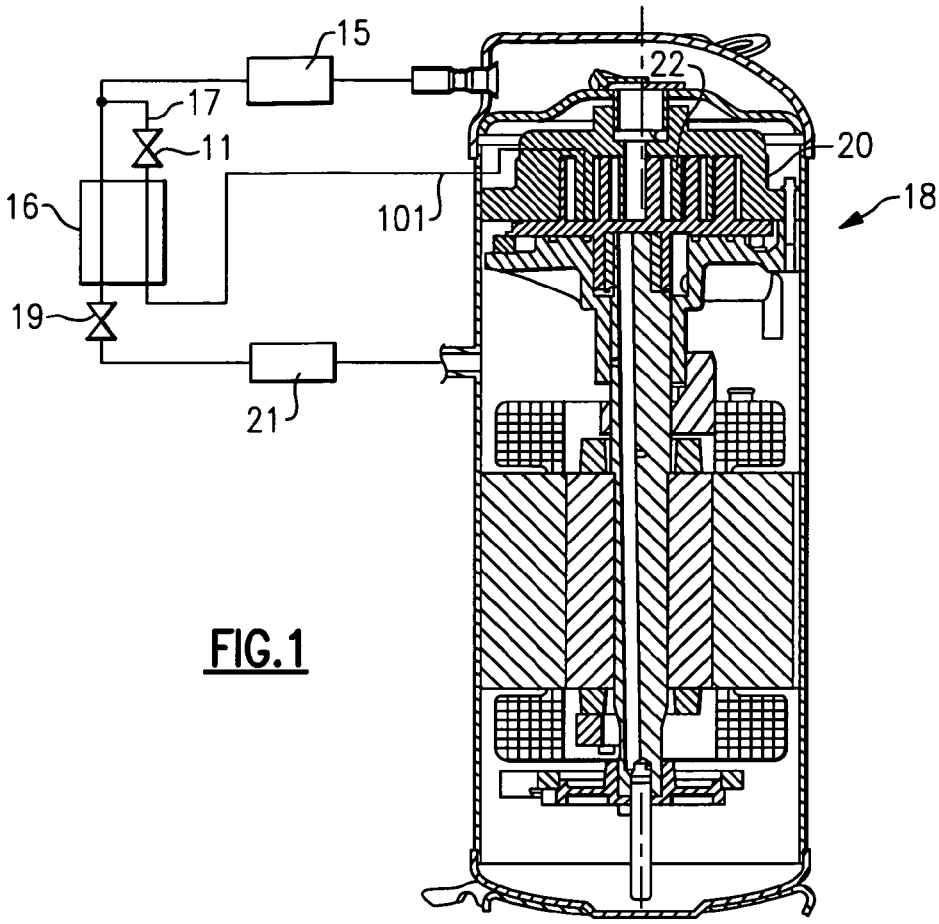
FIG. 1 is a cross-sectional view showing a scroll compressor.

FIG. 1 shows a scroll compressor 18 having a non-orbiting scroll wrap 20 and an orbiting scroll wrap 22. As can be appreciated, compression chambers are defined between the wraps as will be disclosed below. As shown, the compressor 18 delivers a compressed refrigerant to a condenser 15. The refrigerant flows from the condenser 15 to an optional tap line 17 which taps the refrigerant from a main flow line. The tapped refrigerant has passed through an optional economizer expansion device 11, and both the tapped refrigerant and a main refrigerant flow line pass through an optional economizer heat exchanger 16. While the two flows are shown in the same direction in this figure, this is for illustration simplicity only. In practice, typically, the tapped refrigerant flows in an opposed direction through the economizer heat exchanger 16 from the main refrigerant flow. As shown, the tapped refrigerant passes back through an optional economizer injection line 101 into ports 100 (shown schematically) and back into the compression chambers defined between the orbiting and non-orbiting scroll wraps 22 and 20. A main expansion device 19 and an evaporator 21 are downstream of the economizer heat exchanger 16, and refrigerant from the evaporator 21 returns to a suction port in the compressor 18.

Figure 2:
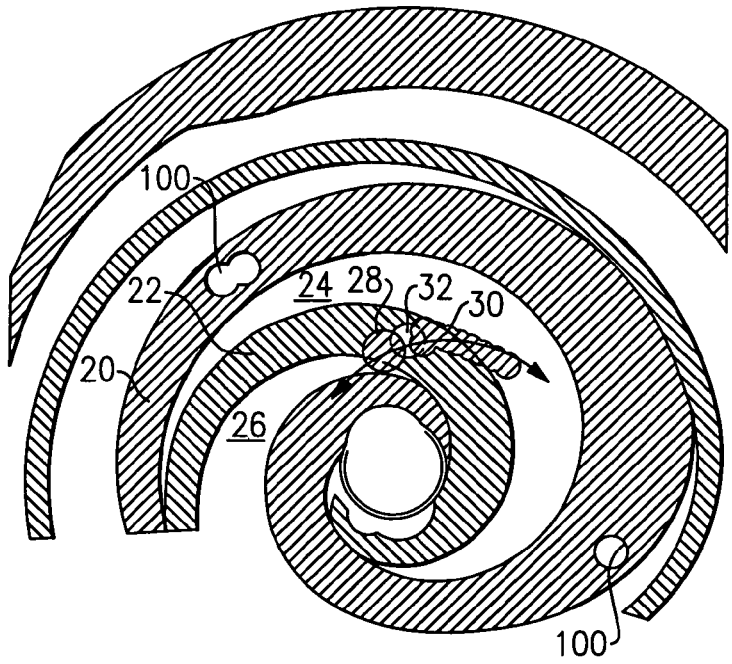
FIG. 2 is a cross-sectional view showing the scroll members.

FIG. 2 shows scroll compressor 18 having non-orbiting scroll wrap 20 and orbiting scroll wrap 22. As can be appreciated, parallel compression chambers 24 and 26 are defined by the wraps 20 and 22. Grooves 28 and 30 are formed in the base of the non-orbiting scroll. As can be appreciated in FIG. 2, a recess 32 formed into the wrap 22 of the orbiting scroll connects the grooves 28 and 30 during a portion of the orbiting cycle. When the grooves 28 and 30 are connected by the corresponding recess 32 on the tip of the orbiting scroll wrap, then the pressure in the chambers 24 and 26 can equalize. The use of the recess 32 ensures this equalization will occur for a greater length in the orbiting cycle than is the case in the prior art.

Figure 3:
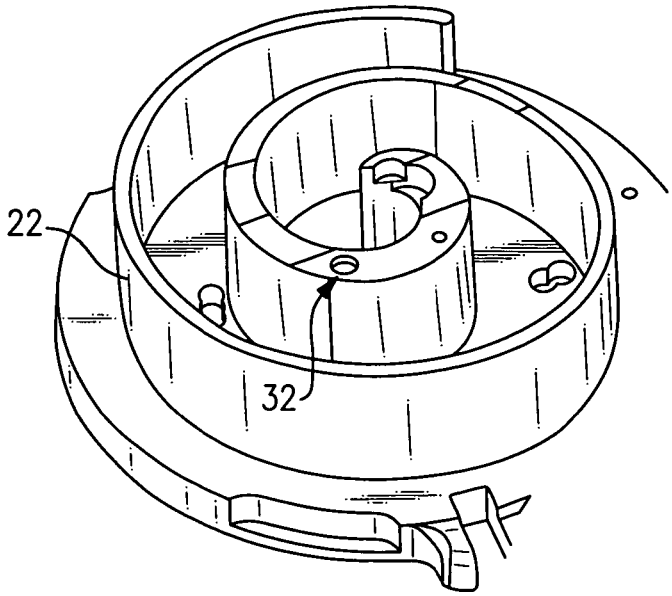
FIG. 3 shows an orbiting scroll member.

As shown in FIG. 3, the orbiting scroll 22 has the recess 32. The recess 32 is shown as a simple, cylindrical recess. However, other shapes may be utilized.

Figure 4:
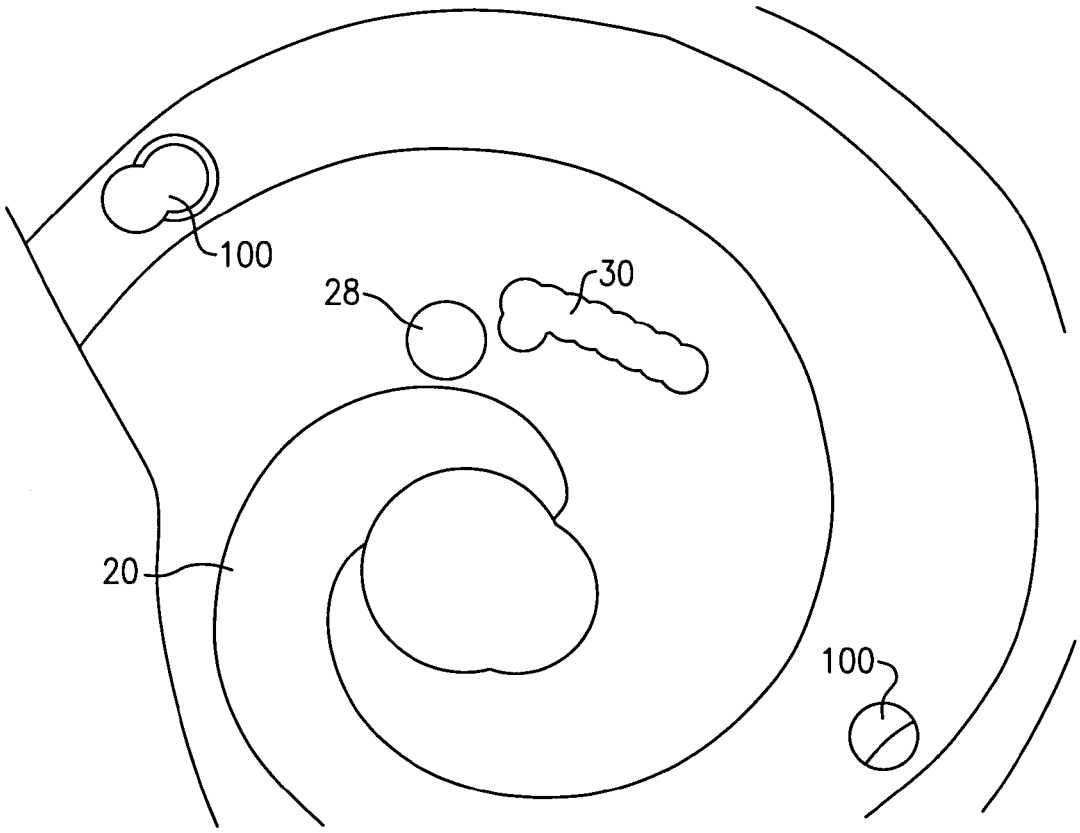
FIG. 4 shows a feature of the non-orbiting scroll.

FIG. 4 shows the grooves 28 and 30 in the non-orbiting scroll member. As can be appreciated from this figure, one of the grooves 28 is generally circular while the other groove 30 is more elongated. The shape of the grooves is selected such that there is a sufficient amount of time through which the two chambers can communicate.

As also shown in FIG. 2, optional economizer vapor injection ports 100 are formed through the non-orbiting scroll wrap 20. As mentioned above, the present invention is particularly valuable in a scroll compressor having the vapor injection. This invention would also be important if a liquid injection is used to reduce the discharge temperature. In this case, for example, the liquid will be tapped from tap 17 and injected into line 101 and then into the intermediate compression chambers. If the liquid injection is used in conjunction with economized vapor injection then the schematic of FIG. 1 would remain essentially the same. If the liquid injection is used as a stand alone feature then the heat exchanger 16 can be eliminated. It should be pointed out that this invention can also be applied where there is no liquid or vapor injection at all. The optional components mentioned above would then be completely eliminated from the schematic of FIG. 1. It also should be pointed out that the liquid injection and vapor injection schematic shown in FIG. 1 is just an example of how vapor injection or liquid injection can be accomplished. Many other schematics are known in the prior art. Moreover, the wraps as shown in FIGS. 1-4 are of the "hybrid" variety having a non-uniform cross-section. However this invention would also work where the wraps are generally of uniform thickness. The present invention is particularly valuable for a scroll compressor having both the economizer injection or liquid injection and hybrid wraps. It should also be pointed out that the number of grooves and/or recesses could be increased from what is shown in the Figures to further enhance the pressure balancing between the chambers. The number of injection ports can also vary from what is shown in the Figures. It is possible, for example, to have just one injection port. As known, a single injection port can communicate with one compression chamber or can be in communication with two compression chambers. It is also possible to have two or more injection ports.

When there is vapor injection, such as from an economizer circuit, the problem of balancing the pressure becomes particularly acute. Thus, with such a feature included in the compressor, the use of the inventive structure becomes even more valuable.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A scroll compressor comprising:

a first scroll member having a base and a generally spiral wrap extending from said base, and a second scroll member having a base and a generally spiral wrap extending from said base, said wraps of said first and second scroll members interfitting to define a pair of parallel compression chambers, said second scroll member driven to orbit relative to the first scroll member; and at least two spaced grooves formed in one of said first and second scroll members, and at least one recess formed in the other of said first and second scroll members, said recess bridging a space between said spaced grooves as said wrap of said second scroll member orbits relative to said first scroll member to selectively communicate refrigerant between said pair of compression chambers, and equalize pressure in said pair of compression chambers.

2. The scroll compressor as recited in claim 1, wherein said recess is formed in a wrap tip of said other of said first and second scroll members.

3. The scroll compressor as recited in claim 1, wherein said recess is generally circular.

4. The scroll compressor as recited in claim 1, wherein said spaced grooves include at least one elongated groove.

5. The scroll compressor as recited in claim 1, wherein said scroll compressor is provided with at least one injection port for injecting an intermediate pressure fluid.

6. The scroll compressor as recited in claim 5, wherein said intermediate pressure fluid is generally liquid.

7. The scroll compressor as recited in claim 5, wherein said intermediate pressure fluid is generally vapor.

8. The scroll compressor as recited in claim 5, wherein said intermediate pressure fluid is a combination of liquid and vapor.

9. The scroll compressor as recited in claim 5, wherein said injection port is an economizer injection port.

10. The scroll compressor as recited in claim 5, wherein said injection port is a liquid injection port.

11. The scroll compressor as recited in claim 1, wherein at least one said wrap has a non-uniform thickness.

12. A scroll compressor comprising:

a first scroll member having a base and a generally spiral wrap extending from said base, and a second scroll member having a base and a generally spiral wrap extending from said base, said wraps of said first and second scroll members interfitting to define a pair of parallel compression chambers, said second scroll member driven to orbit relative to said first scroll member;

two spaced grooves formed in said base of said first scroll member, and a recess formed in the wrap tip of said second scroll member, said recess bridging a space between said two spaced grooves as the wrap of said second scroll member orbits relative to said first scroll member, and the bridging selectively communicating refrigerant between said pair of compression chambers to equalize pressure in said pair of compression chambers; and injection ports for injecting an intermediate pressure fluid into each of said pair of compression chambers from an economizer cycle.

13. The scroll compressor as recited in claim 12, wherein said bridging recess is generally circular.

14. The scroll compressor as recited in claim 12, wherein said two grooves include at least one elongated groove and one smaller groove.

* * * * *